US010273125B2

(12) United States Patent
Hall et al.

(10) Patent No.: US 10,273,125 B2
(45) Date of Patent: Apr. 30, 2019

(54) BRISTLED WINCH-GUIDE

(71) Applicants: David R. Hall, Provo, UT (US); Daniel Madsen, Vineyard, UT (US); Benjamin Taylor, Provo, UT (US); Lloyd J. Wilson, Herriman, UT (US)

(72) Inventors: David R. Hall, Provo, UT (US); Daniel Madsen, Vineyard, UT (US); Benjamin Taylor, Provo, UT (US); Lloyd J. Wilson, Herriman, UT (US)

(73) Assignee: Hall Labs LLC, Provo, UT (US)

( * ) Notice: Subject to any disclaimer, the term of this patent is extended or adjusted under 35 U.S.C. 154(b) by 322 days.

(21) Appl. No.: 15/297,792

(22) Filed: Oct. 19, 2016

(65) Prior Publication Data

US 2018/0105403 A1 Apr. 19, 2018

(51) Int. Cl.
*B66D 1/38* (2006.01)
*B66D 1/00* (2006.01)

(52) U.S. Cl.
CPC ..... *B66D 1/00* (2013.01); *B66D 1/38* (2013.01); *B66D 2700/0191* (2013.01)

(58) Field of Classification Search
CPC ..... B66D 1/38; B66D 1/00; B66D 2700/0191
See application file for complete search history.

(56) References Cited

U.S. PATENT DOCUMENTS 2,348,987 A * 5/1944 Lock ..... B66D 1/38 200/47
2,660,382 A * 11/1953 Wilson ..... B66D 1/36 242/157.1
2,810,439 A * 10/1957 McCullough ..... E21B 33/072 166/385
4,468,006 A * 8/1984 Frommherz ..... B66D 1/741 242/157 R
4,650,162 A * 3/1987 Frommherz ..... B66D 1/7405 254/283
5,636,648 A * 6/1997 O'Brien ..... B08B 9/04 134/107
6,811,112 B1 * 11/2004 Currie ..... B65H 54/2872 242/157.1
8,141,260 B2 * 3/2012 Pellen ..... G01B 11/26 33/366.24
9,637,360 B2 * 5/2017 Hall ..... B66D 5/32
9,719,632 B2 * 8/2017 Weidner ..... F16M 13/022
10,173,870 B1 * 1/2019 Hall ..... B66D 1/39
2011/0162573 A1 * 7/2011 Race ..... H01Q 1/04 114/328
2013/0193256 A1 * 8/2013 Hawkes ..... B65H 75/4484 234/557
2014/0166953 A1 * 6/2014 Wright ..... B66D 1/56 254/270
2018/0093870 A1 * 4/2018 Hall ..... B66D 1/38
2018/0105403 A1 * 4/2018 Hall ..... B66D 1/00
2018/0105404 A1 * 4/2018 Hall ..... B66D 1/485
2018/0179032 A1 * 6/2018 Hall ..... B66D 1/38

* cited by examiner

*Primary Examiner* — Michael E Gallion

(57) ABSTRACT

A winch is described comprising a guide that includes a fairlead for positioning a cable around a rotatable drum, wherein one or more bristles are positioned within an orifice in the fairlead. The bristles may have an angular orientation such that they provide active cable wiping during winding and passive cable wiping during unwinding of the cable around the drum. Active wiping may reduce the likelihood that dirt, mud, debris, and/or other materials accumulate within the winch during winding.

10 Claims, 13 Drawing Sheets

BRISTLED WINCH-GUIDE

TECHNICAL FIELD

The present disclosure relates generally to the field of winches and hoists. More specifically, the present disclosure relates to an apparatus and method for cleaning a winch cable.

BACKGROUND

Winches are hauling or lifting devices, which pull in or let out a cable. The winch pulls in the cable by winding the cable around a horizontal rotating drum, or unwinding the cable from said drum. Winding the cable uniformly around the drum is optimal so that the cable does not bunch up around a single location on the drum and potentially jam the winch during winding. Dirt, mud, debris, and/or other materials can latch onto the cable when the cable is wound around the drum, causing an accumulation or buildup of said materials within the winch. Such buildup can disrupt uniform winding of the cable around the drum, and increase the likelihood of the winch jamming. Additionally, said materials may accumulate in other locations on the winch such as within a fairlead, cable guide, around a tensioner, in the gears, and/or other places where buildup may be unwanted. Thus, a need exists for an improvement to existing winches in order to reduce the amount of said materials that accumulate within the winch. Embodiments disclosed herein may improve performance of winches by reducing the ability for said materials to accumulate within the winch.

SUMMARY OF THE INVENTION

Disclosed herein is a winch, comprising a bristled winch-guide, which may reduce the likelihood that dirt, mud, debris, and/or other materials accumulate within the winch during winding. In one embodiment, a winch comprises a rotatable drum mounted within a frame and supported for rotation about the drum's longitudinal axis. As the drum rotates, a cable that is connected to the drum is wound and unwound around the drum, according to one embodiment. The winch also includes a guide that is mounted on the frame and is adjacent the drum, which positions the cable onto the drum. The guide comprises guide rods positioned substantially parallel to the drum axis and a fairlead slidably attached to the guide rods.

The fairlead may include an orifice through which the cable passes. The orifice, according to one embodiment, comprises an interior wall with one or more bristles extending therefrom that are in contact with the cable. The bristles may be at an angular orientation that corresponds to the direction the cable travels when being unwound. This orientation of the bristles provides active cable wiping during winding and passive cable wiping during winding of the cable around the drum. In one embodiment, the interior wall is movable, and moves the bristles to provide active cable wiping when winding the cable onto the drum. During unwinding, the movable interior wall may move little, if at all, according to one embodiment.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which:

FIG. 4A depicts a side view of an embodiment of a fairlead through which a cable passes through;

DETAILED DESCRIPTION

In the following detailed description, numerous specific details are provided for a thorough understanding of the various embodiments disclosed herein. The embodiments disclosed herein can be manufactured without one or more of the specific details, or with other methods, components, materials, etc. In addition, in some cases, well-known structures, or characteristics may be combined in any suitable manner in one or more alternative embodiments.

Figure 1A:
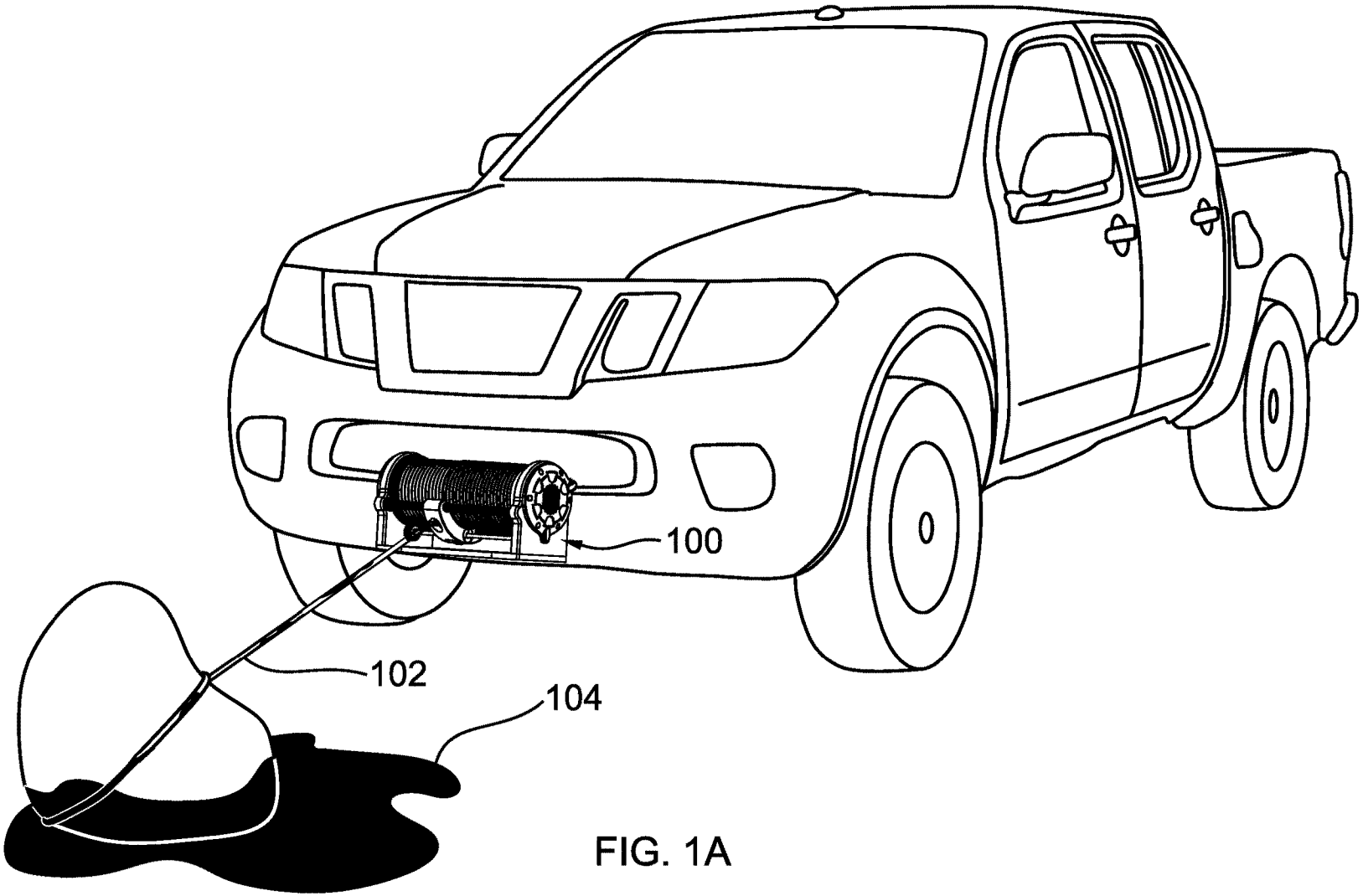
FIG. 1A depicts a winch, according to one embodiment, with a cable that is submerged in a muddy material.

FIG. 1A depicts a winch 100, according to one embodiment, with a cable 102 that is submerged in a muddy material 104. The muddy material 104 can stick to the cable 102 and accumulate within the winch 100. Optimally, the cable 102 will be uniformly distributed within the winch 100, but the muddy material 104, dirt, and/or other debris that accumulates in the winch 100 can disrupt the uniform distribution of the cable 102 when it is wound. Such disruptions in the cable 102 can cause the cable 102 to jam the winch 100 such that it is unable to pull in and/or let out the cable 102.

Figure 1B:
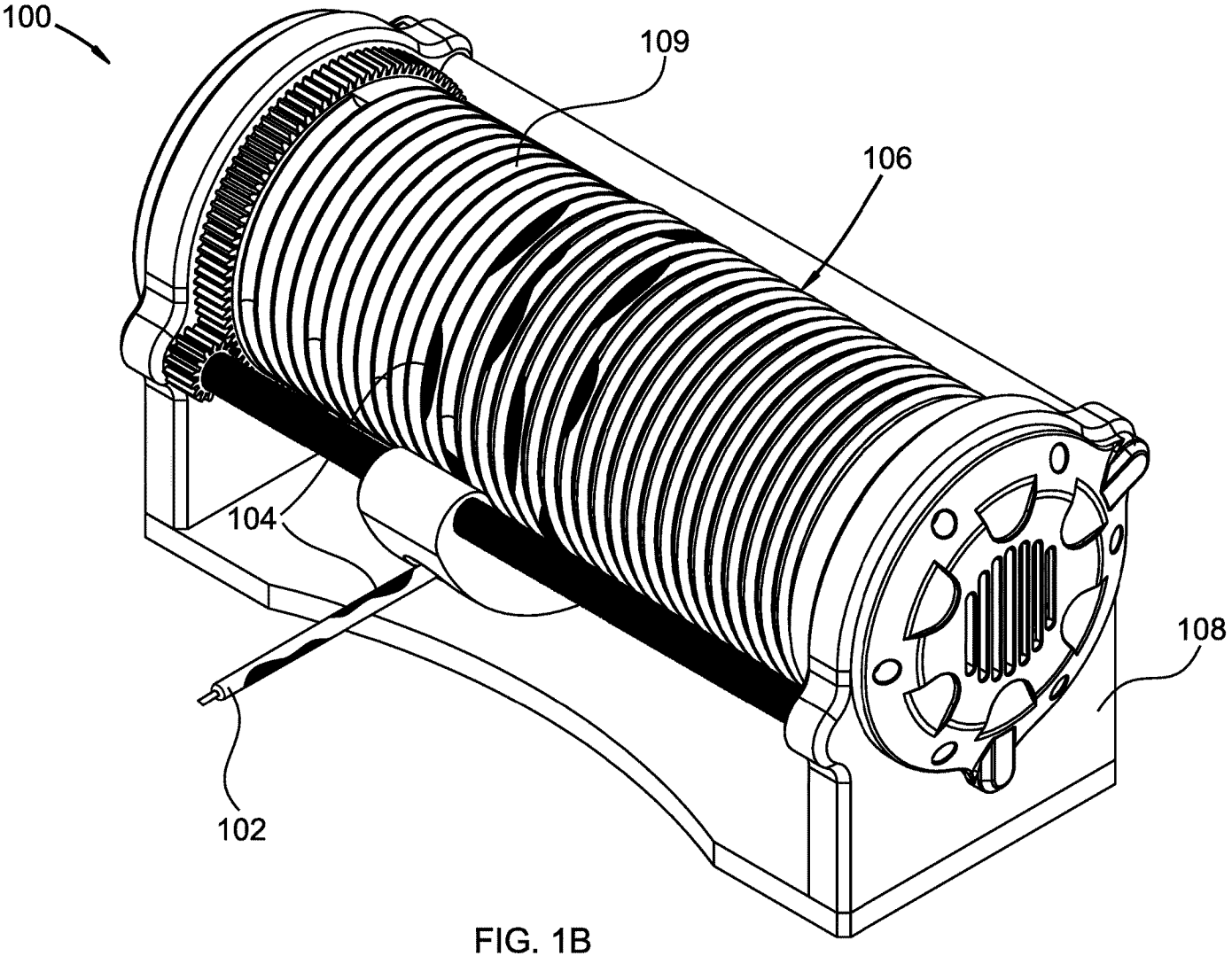
FIG. 1B is a close-up view of the winch of FIG. 1A, which shows muddy material on the cable and around a rotatable drum of the winch, according to one embodiment.

FIG. 1B is a close-up view of the winch 100 of FIG. 1A, which shows muddy material 104 on the cable 102 and around a rotatable drum 106 of the winch 100, according to one embodiment. The rotatable drum 106 is mounted within a frame 108 and supported for rotation about the drum's 106 longitudinal axis. The cable 102 is connected to the drum 106 such that when the cable 102 is wound around the drum 106 the cable 102 is pulled in, and when the cable 102 is unwound from the drum 106 the cable 102 is let out. The drum 106 in many embodiments is shaped as a right circular cylinder; however, the drum 106 can be of any variety shapes including an elliptic cylinder, a parabolic cylinder, a hyperbolic cylinder, an oblique cylinder, a cuboid, a rounded cuboid, a triangular prism, and/or any of a variety of other shapes. In some embodiments, the drum 106 includes a plurality of helical grooves 109 to assist in uniformly winding the cable 102 onto the drum 106.

The cable 102 may comprise any of a variety materials compatible with use on a winch 100, such as hemp, linen, flax, cellulose, carbon, wool, hair, feathers, cotton, coir, jute, straw, silk, sisal, polymers, nylon, Dyneema®, Kevlar®, rayon, orlon, polypropylene, polyesters, polyethylene, aramids, acrylics, copper, iron, steel, stainless steel, bronze, nichrome, carbon, solder, titanium, zinc, silver, gold, tungsten, aluminum, and/or other suitable material.

Figure 2:
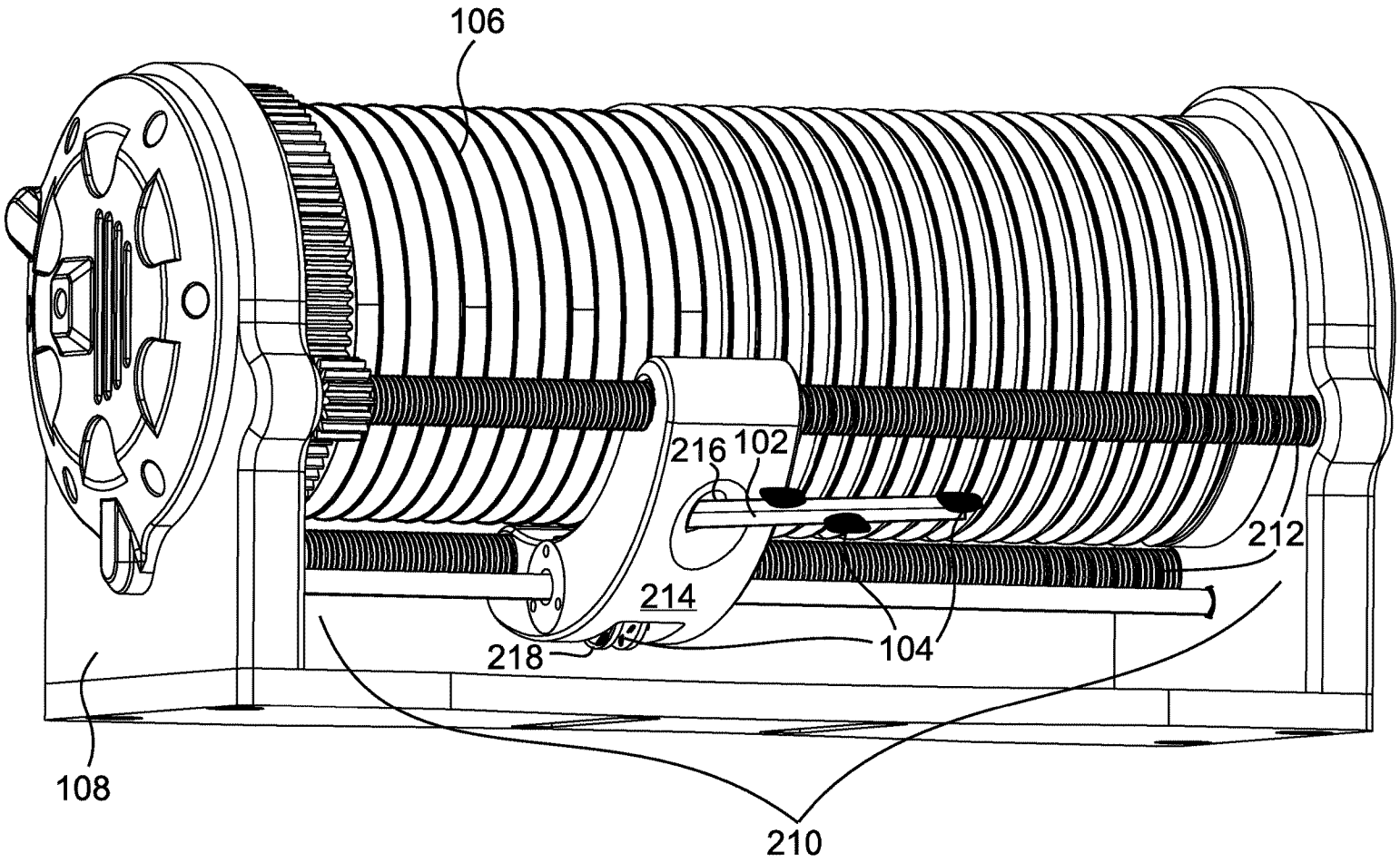
FIG. 2 is a perspective view of an embodiment of a winch with muddy material on the cable and stuck onto the tensioner.

FIG. 2 is a perspective view of an embodiment of a winch 100 with muddy material 104 on the cable 102 and stuck onto the tensioner 218. The winch 100 includes a guide 210 mounted on the frame 108 adjacent the drum 106 for positioning the cable 102 onto the drum 106. The guide 210 includes guide rods 212 disposed substantially parallel to the drum 106 axis, which support a fairlead 214 that is slidably attached to the guide rods 212. The fairlead 214 includes an orifice 216 through which the cable 102 passes during winding and unwinding. The tensioner 218, according to one embodiment, is a rotatable wheel positioned within the fairlead 214 such that the cable 102 passes along the tensioner 218 and is in frictional contact with the tensioner 218. The tensioner 218 rotates at a rotational speed that exceeds the rotational speed of the drum 106 as the cable 102 is let out from the drum 106, and passively rotates as the cable 102 is pulled in an wound onto the drum 106.

Figure 3:
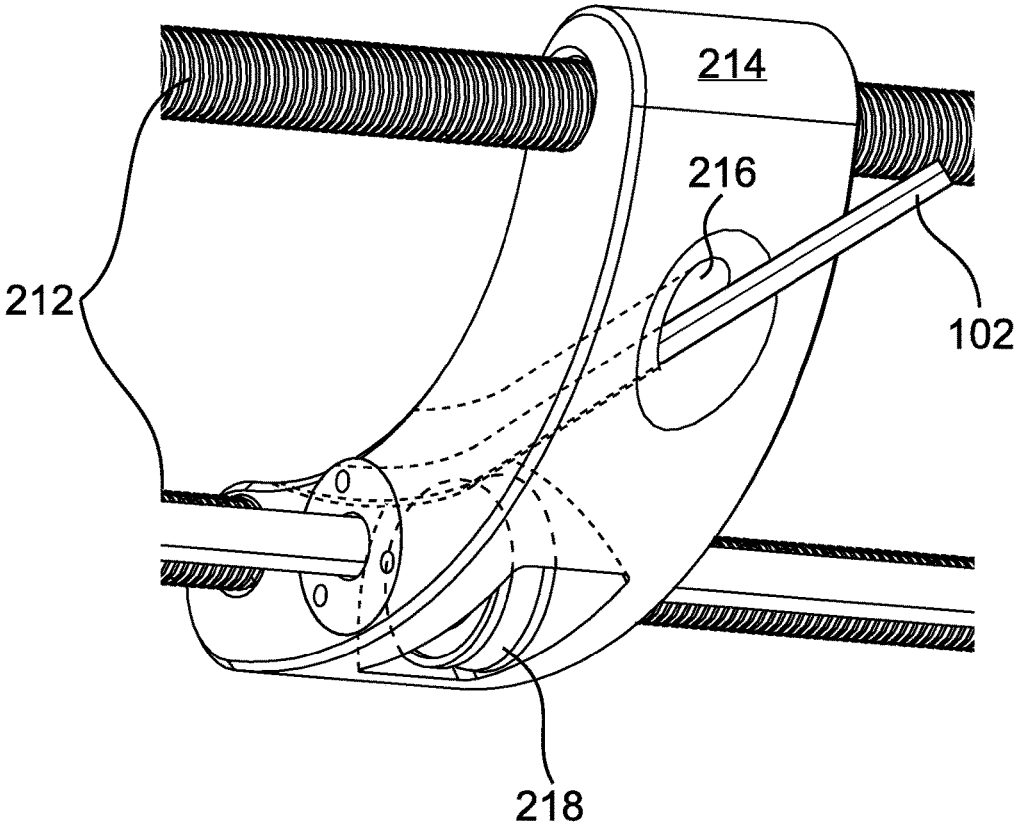
FIG. 3 illustrates a transparent view of a fairlead supported by guide rods, according to one embodiment.

FIG. 3 illustrates a transparent view of a fairlead 214 supported by guide rods 212, according to one embodiment. The fairlead 214 includes an orifice 216 through which the cable 102 passes during winding and unwinding. The cable 102 is in frictional contact with the tensioner 218 within the fairlead 214.

Figure 4A:
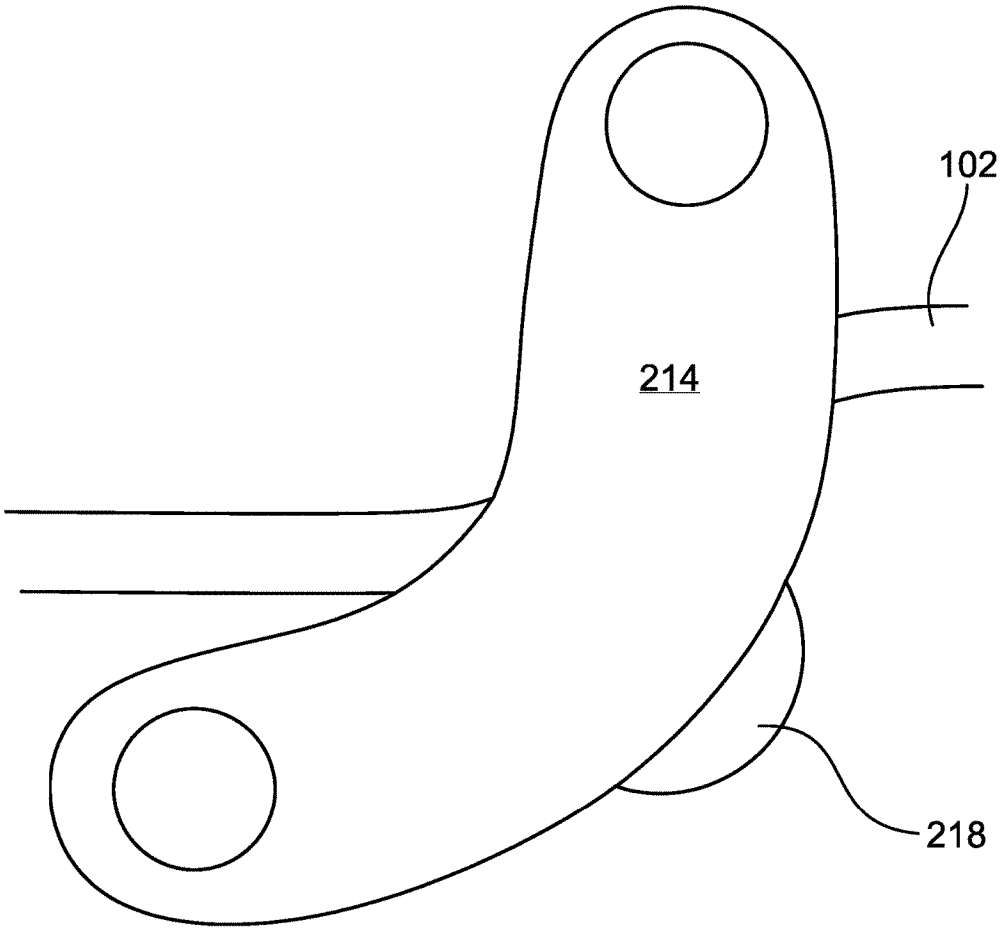

FIG. 4A depicts a side view of an embodiment of a fairlead 214 through which a cable 102 passes through. The fairlead 214 includes a tensioner 218, according to one embodiment.

Figure 4B:
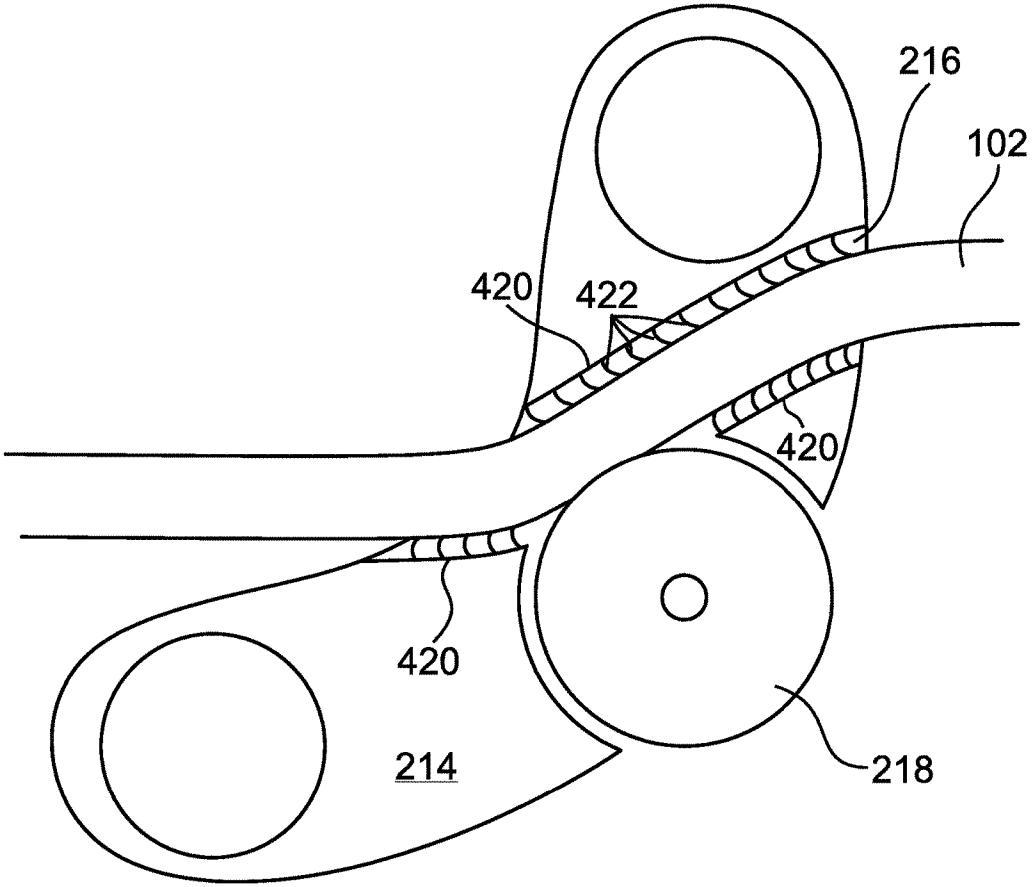
FIG. 4B is a cross-sectional view of the fairlead of FIG. 4A.

FIG. 4B is a cross-sectional view of the fairlead 214 of FIG. 4A. The fairlead 214 includes an orifice 216 with an interior wall 420 from which one or more bristles 422 extend and are in contact with the cable 102. The bristles 422, according to one embodiment, are at an angular orientation corresponding to a direction of travel of the cable 102 during unwinding. This angular orientation provides active wiping of the cable 102 when the cable 102 is being wound onto the drum (see FIG. 2) and passive wiping of the cable 102 during unwinding of the cable 102. The tensioner 218 can replace a portion of the interior wall 420, according to one embodiment.

According to various embodiments, the bristles 422 may be comprised of hair, nylon, rubber, plastic, bass fiber, bassine, kottool, palmyra, rice root, tampico fiber, union fiber, carbon fiber, vegetable fiber, polyester, peek, polyethylene, polypropylene, polystyrene, aluminum, brass, stainless steel, phosphor bronze, or other abrasive material, or compounds or combinations thereof. The bristles 422 may be flagged, unflagged, or include combinations thereof.

Figure 5A:
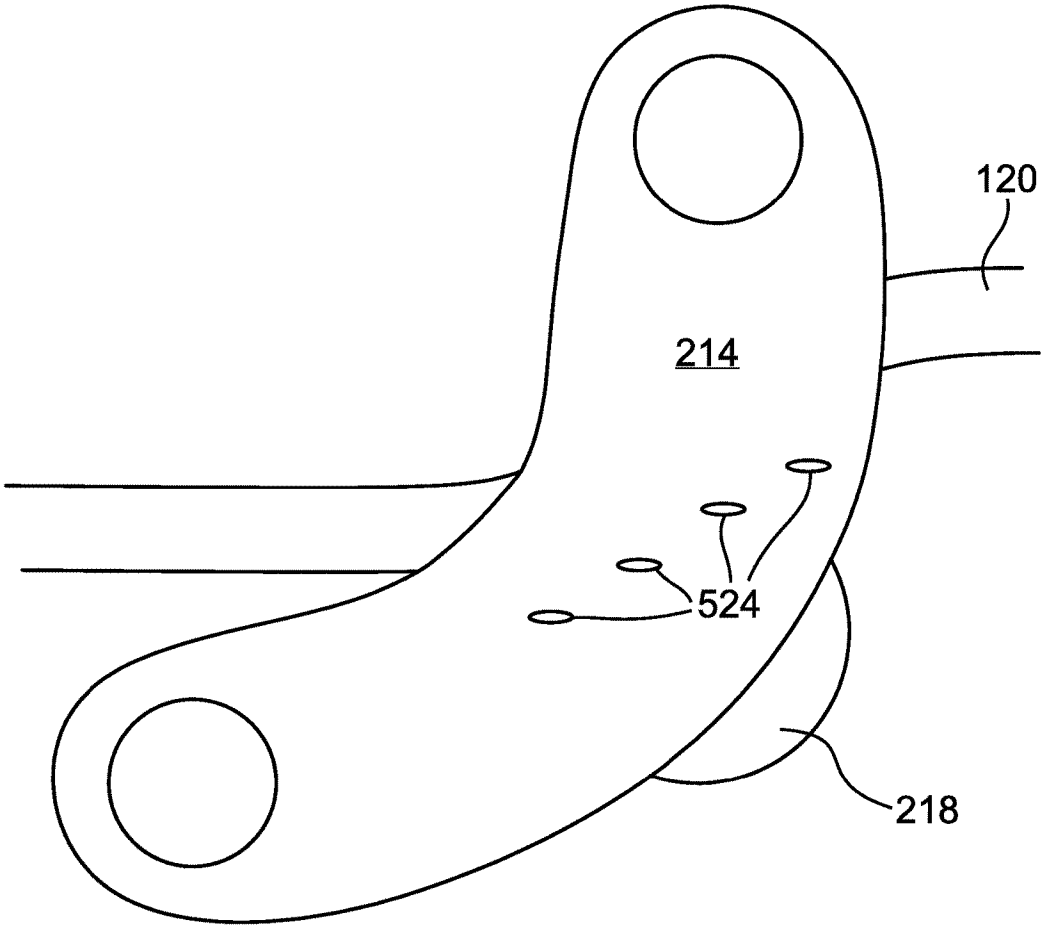
FIG. 5A is a side view of an embodiment of a fairlead with discharge openings.

FIG. 5A is a side view of an embodiment of a fairlead 214 with discharge openings 524. According to various embodiments, one or more discharge openings 524 can be arranged in any number of configurations that allow for mud, dirt, debris, or other material that attaches to the cable 102 may be discharged from one or more channels (not shown). Such discharge openings 524 may be independent from the any openings associated with the tensioner 218, or may be closely associated with any openings in the fairlead 214 the tensioner 218 utilizes to function properly.

Figure 5B:
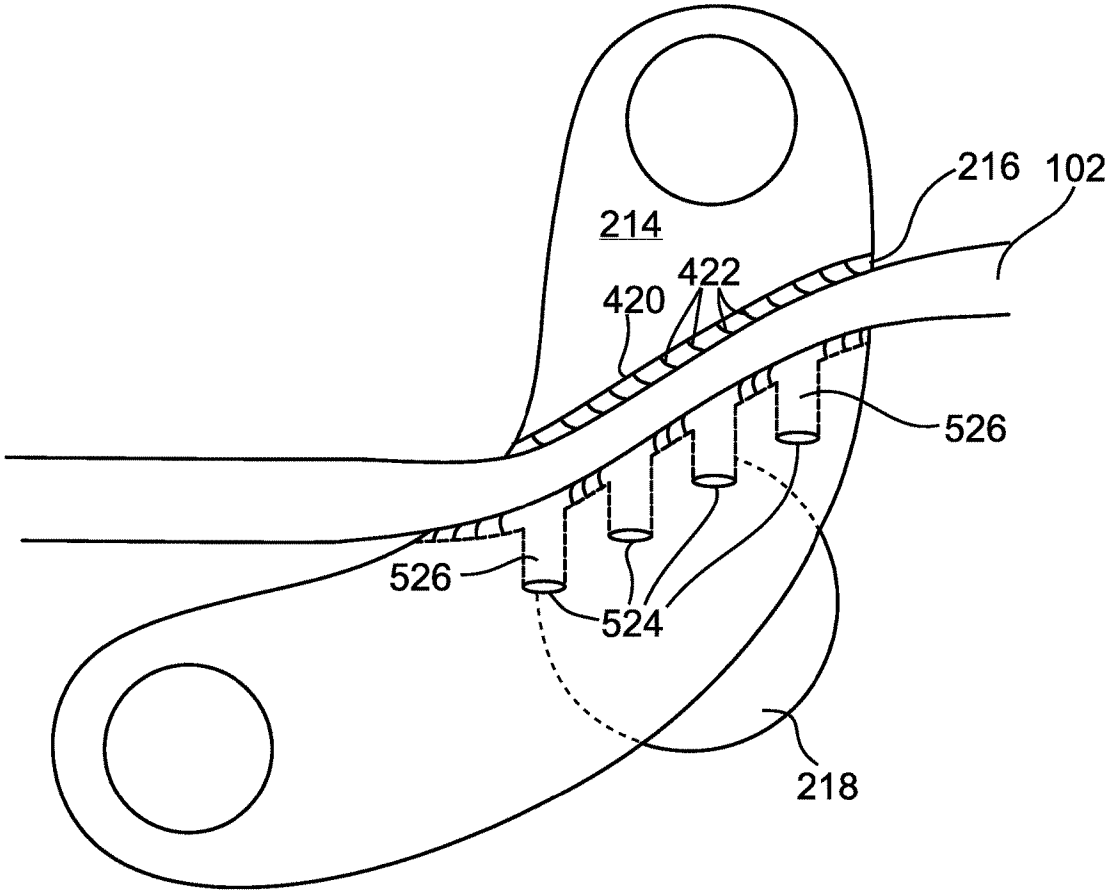
FIG. 5B is a cross-sectional view of the fairlead of FIG. 5A.

FIG. 5B is a cross-sectional view of the fairlead 214 of FIG. 5A. The fairlead 214 includes an orifice 216 with an interior wall 420 with bristles 422 extending therefrom, according to one embodiment. The bristles 422 are in contact with the cable 102 such that dirt, mud, debris, or other material that is attached to the cable 102 can be wiped from the cable 102 during winding. The fairlead 214 includes disposal channels 526 extending from the interior wall 420 of the orifice 216 to an outer surface of the fairlead 214. The disposal channels 526 include discharge openings 524 for the dirt, mud, debris, or other material that is wiped from the cable 102 to exit the orifice 216.

Figure 6A:
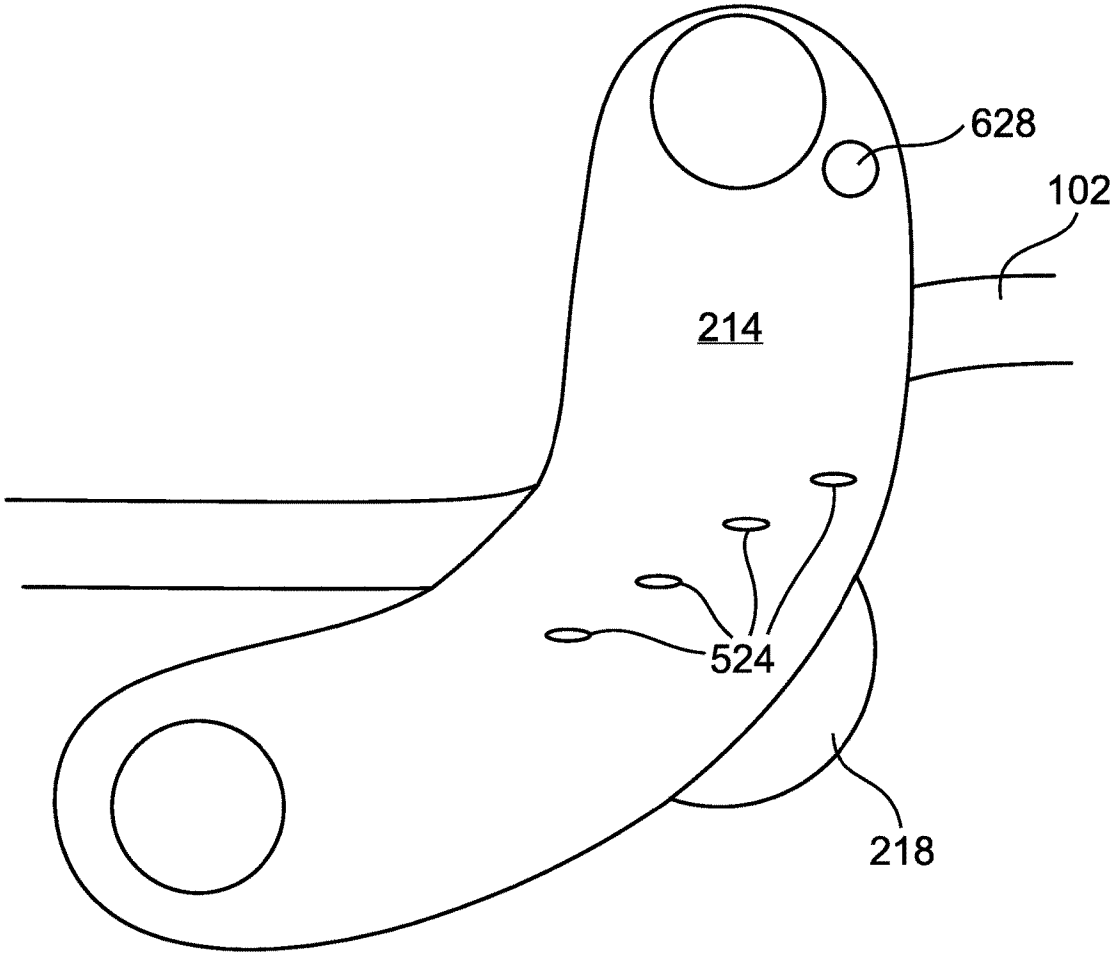
FIG. 6A is a side view of an embodiment of a fairlead with a surface aperture into which a liquid may be injected.

FIG. 6A is a side view of an embodiment of a fairlead 214 with a surface aperture 628 into which a liquid may be injected. Other embodiments may include more than one aperture 628 for injecting liquid. The one or more apertures may be arranged such that it is easily accessible to inject a liquid into the aperture to fill and/or replenish any liquid within the fairlead 214.

Figure 6B:
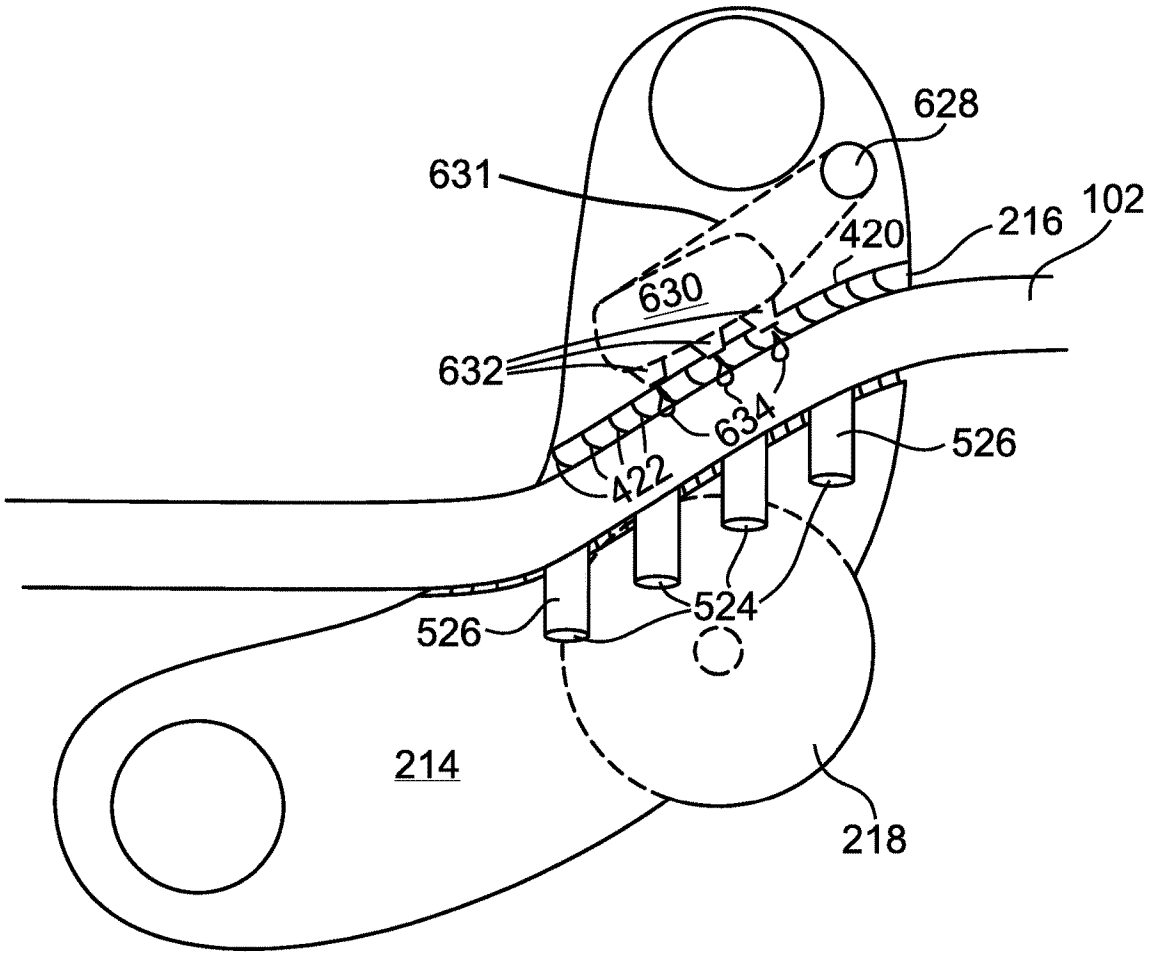
FIG. 6B illustrates a transparent view of the fairlead from FIG. 6A.

FIG. 6B illustrates a transparent view of the fairlead 214 from FIG. 6A. The fairlead 214, according to one embodiment, may comprise at least one chamber 630 for storing one or more liquids 634. The fairlead 214 may include a conduit 631 connecting the surface aperture 628 to the chamber 630 such that one or more liquids 634 may be periodically injected into the chamber 630. One or more nozzles 632 may be operatively connected to one or more chambers 630 to dispense liquid 634 onto the cable 102. The nozzles 632 may be directed from the chamber 630 towards the cable 102 such that the nozzles penetrate the interior wall 420 of the orifice 216.

The liquid 634, according to one embodiment, may supplement the wiping provided by the bristles 422, and wash any dirt, mud, debris, or other material off the cable. The liquid 634 may also serve to rinse out the one or more disposal channels 526 such that dirt, mud, debris, or other material does not accumulate within the channels 526. In another embodiment, the liquid 634 may lubricate the cable 102 with a material resistant to the accumulation of dirt, mud, debris, or other materials onto the cable 102.

Figure 6C:
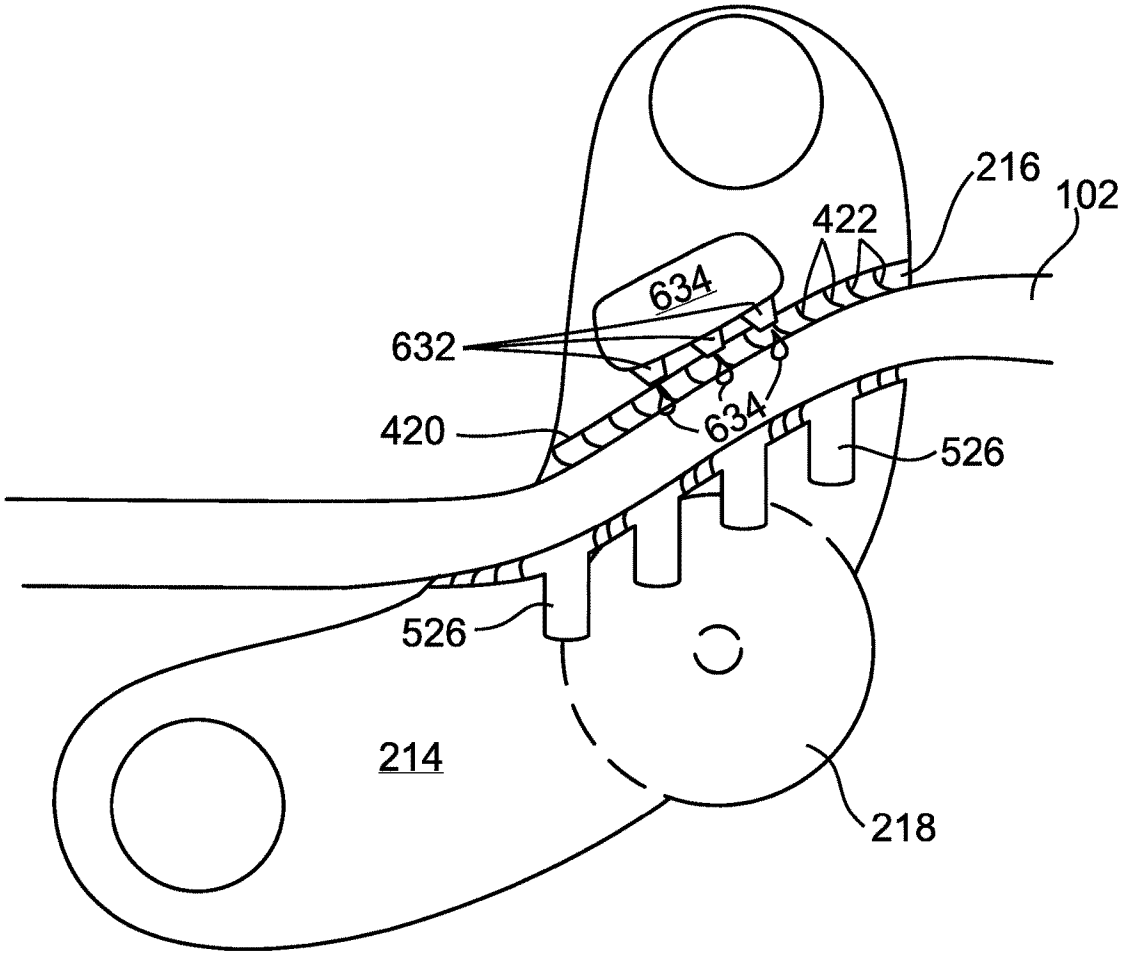
FIG. 6C is a cross-sectional view of the fairlead from FIG. 6A.

FIG. 6C is a cross-sectional view of the fairlead 214 from FIG. 6A. In one embodiment, the nozzles 632 may include a hinged-stopper and/or filter (not shown) between the liquid 634 and an opening in the nozzles 632. By utilizing the hinged-stopper and/or filter mechanism, distribution of the liquid 634 may be regulated by the nozzles 632 in order to reserve a portion of the liquid 634 within the chamber 630 for future uses.

Figure 7:
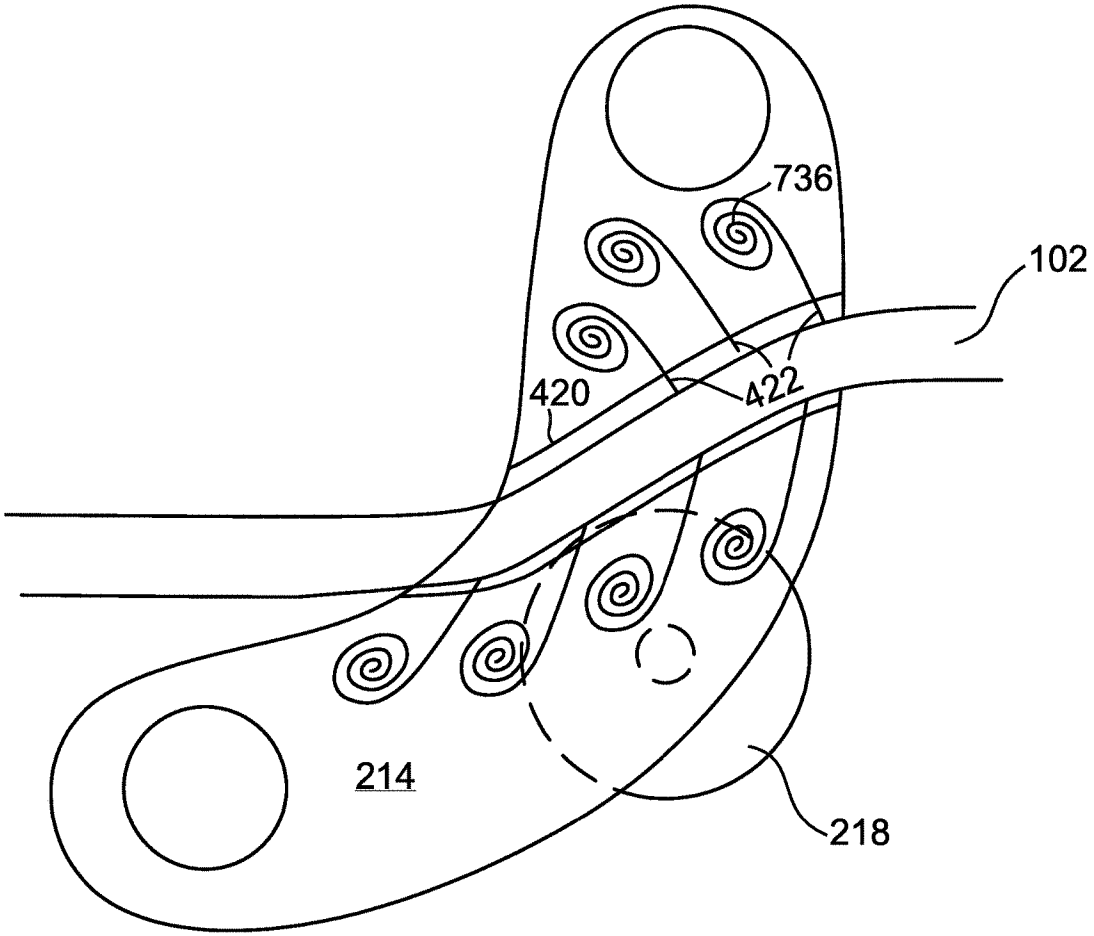
FIG. 7 is a cross-sectional view of an embodiment of a fairlead that includes spiral reserves of bristles.

FIG. 7 is a cross-sectional view of an embodiment of a fairlead 214 that includes spiral reserves 736 of bristles 422. In various embodiments, the reserves 736 of one or more bristles 422 are positioned such that as the bristles 422 wear down and/or break off, new bristle material feeds into the orifice 216. According to one embodiment, the reserve 736 of bristles 422 may let out more material due to suction, pressure, and/or stress on the reserve 736 such that more material is let out when there is insufficient bristle material exposed within the orifice 216 to come into contact with the cable 102.

Figure 8:
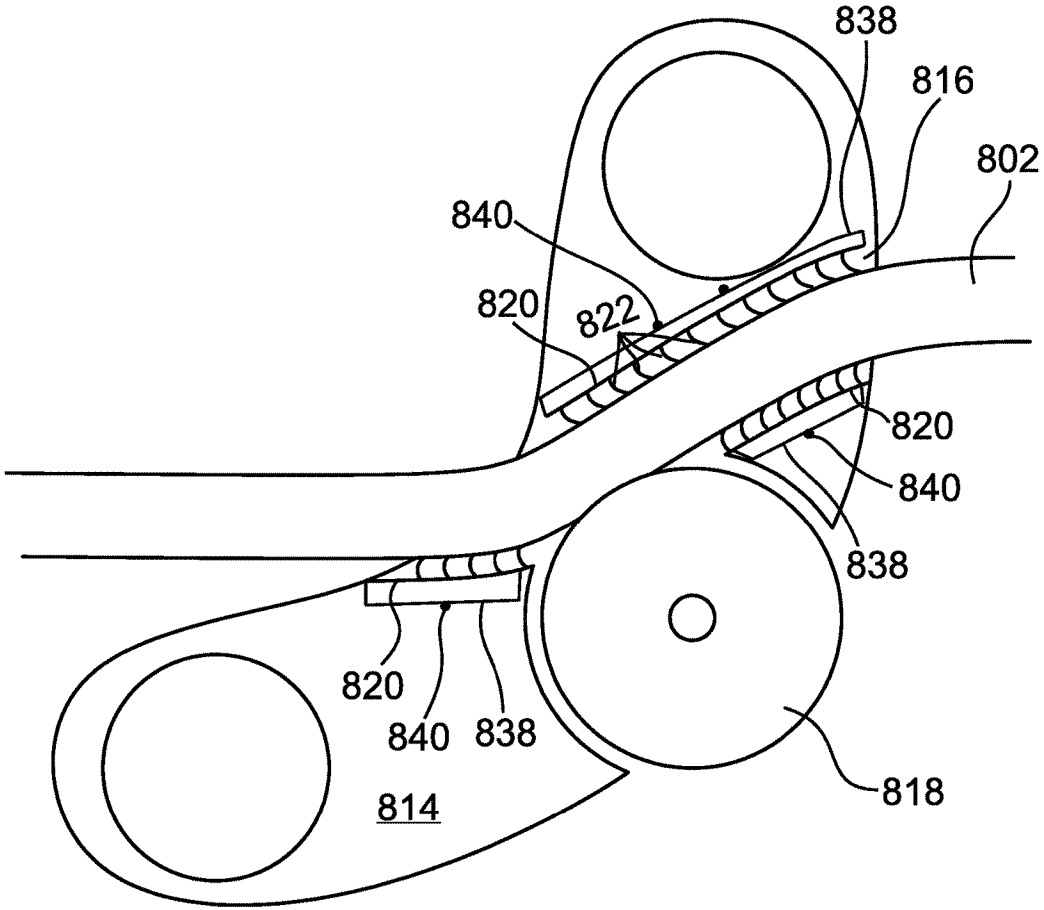
FIG. 8 is a cross-sectional view of an embodiment of a fairlead with a movable interior wall.

FIG. 8 is a cross-sectional view of an embodiment of a fairlead 814 with a movable interior wall 820. Bristles 822 extend from the interior wall 820 and are in contact with a cable 802. The interior wall 820 provides active wiping of the cable 802 during winding by rapidly moving to dislodge dirt, mud, debris, or other material that is attached to the cable 802. A back surface 822 of the interior wall 820, which is the surface opposite the bristles 822, may be operatively connected to one or more joints 840 attached to the fairlead 814 upon which the interior wall 820 pivots and/or vibrates.

In other embodiments, the interior wall 820 is supported for rotation and/or oscillations about an axis and rotates about said axis during winding. According to one embodiment, a battery may power movement of the interior wall 820. The battery may be charged by a regenerative energy recovery mechanism, which converts kinetic energy generated from friction between the cable 802 and bristles 822 of claim 10 into electric energy.

The invention claimed is:

1. A winch, comprising:

a rotatable drum mounted within a frame and supported for rotation about the drum's longitudinal axis;

a cable connected to the drum, wherein the cable is wound and unwound around the drum;

a guide mounted on the frame and adjacent the drum for positioning the cable onto the drum;

the guide comprising guide rods disposed substantially parallel to the drum axis;

a fairlead slidably attached to the guide rods;

the fairlead comprising an orifice through which the cable passes;

the orifice comprising an interior wall comprising a plurality of bristles extending therefrom in contact with the cable;

the bristles comprising an angular orientation corresponding to a direction of travel of the cable as it is being unwound, wherein the bristles provide active cable wiping when winding the cable onto the drum and passive cable wiping when unwinding the cable from the drum.

2. The winch of claim 1, wherein the fairlead comprises one or more disposal channels extending from the interior wall of the orifice to an outer surface of the fairlead.

3. The winch of claim 1, wherein the fairlead comprises a tensioner replacing a portion of the interior wall of the orifice.

4. The winch of claim 1, wherein the fairlead comprises at least one chamber for storing one or more liquids.

5. The fairlead of claim 4, further comprising a conduit connecting the one or more chambers to at least one surface aperture of the fairlead.

6. The fairlead of claim 4, further comprising one or more nozzles operatively connected to one ore more of the chambers, wherein the nozzles penetrate the interior wall of the orifice of claim 1.

7. The fairlead of claim 6, wherein the nozzles comprise a hinged-stopper and/or filter between the liquid and an opening in the nozzles.

8. The winch of claim 1, wherein the one or more bristles are comprised of a reserve of bristle material that feeds into the orifice.

9. The winch of claim 1, wherein the bristles are comprised of hair, nylon, rubber, plastic, bass fiber, bassine, kottool, palmyra, rice root, tampico fiber, union fiber, carbon fiber, vegetable fiber, polyester, peek, polyethylene, polypropylene, polystyrene, aluminum, brass, stainless steel, phosphor bronze, or other abrasive material, or compounds or combinations thereof.

10. The winch of claim 1, wherein the bristles are flagged or unflagged, or combinations thereof.

* * * * *